US008807053B2

(12) United States Patent
Kauppinen

(10) Patent No.: US 8,807,053 B2
(45) Date of Patent: Aug. 19, 2014

(54) FLUIDIZED BED HEAT EXCHANGER FOR A CIRCULATING FLUIDIZED BED BOILER AND A CIRCULATING FLUIDIZED BED BOILER WITH A FLUIDIZED BED HEAT EXCHANGER

(75) Inventor: Kari Kauppinen, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 1460 days.

(21) Appl. No.: 12/299,982

(22) PCT Filed: May 9, 2007

(86) PCT No.: PCT/FI2007/050264

§ 371 (c)(1),
(2), (4) Date: Apr. 16, 2009

(87) PCT Pub. No.: WO2007/128883

PCT Pub. Date: Nov. 15, 2007

(65) Prior Publication Data

US 2009/0293818 A1 Dec. 3, 2009

(30) Foreign Application Priority Data

May 10, 2006 (FI) ..... 20065308

(51) Int. Cl.

| | |
|---|---|
| ***F23G 5/30*** | (2006.01) |
| ***F22B 31/00*** | (2006.01) |
| ***F23C 10/32*** | (2006.01) |
| ***F23C 10/04*** | (2006.01) |

(52) U.S. Cl.

CPC ..... *F23C 10/04* (2013.01); *F23C 2206/103* (2013.01); *F22B 31/0092* (2013.01); *F23C 10/32* (2013.01)

USPC ..... 110/245; 110/216; 122/4 D

(58) Field of Classification Search

CPC ..... F22B 31/0092; F23C 10/32; F23C 10/04; F23C 2206/103

USPC ..... 110/348, 216, 245; 122/4 D

See application file for complete search history.

(56) References Cited

U.S. PATENT DOCUMENTS

| | | | | |
|---|---|---|---|---|
| 5,069,170 | A | 12/1991 | Gorzegno et al. | 122/4 D |
| 5,095,854 | A | 3/1992 | Dietz | 122/4 D |

(Continued)

FOREIGN PATENT DOCUMENTS

| | | | |
|---|---|---|---|
| CN | 1132547 | A | 10/1996 |
| EP | 0 444 926 | A2 | 2/1991 |

(Continued)

OTHER PUBLICATIONS

International Search Report dated May 7, 2008, which was mailed in a Communication dated May 23, 2008, and which issued in corresponding International Application No. PCT/FI2007/050264.

(Continued)

*Primary Examiner* — Kang Hu
*Assistant Examiner* — John Bargero
(74) *Attorney, Agent, or Firm* — Fitzpatrick, Cella, Harper & Scinto

(57) ABSTRACT

A heat exchanger and a circulating fluidized bed boiler with a heat exchanger including a first fluidized bed heat exchange chamber and a second fluidized bed heat exchange chamber, arranged in connection with a furnace of the circulating fluidized bed boiler, a first inlet channel for introducing hot solids from a particle separator of the external circulation of the circulating fluidized bed boiler into the first heat exchange chamber, a second inlet channel for introducing solids to the second heat exchange chamber, a first discharge for removing a first portion of the cooled solids from the first heat exchange chamber to the second inlet channel and a second discharge for removing cooled solids from the second heat exchange chamber to the furnace, the heat exchange chamber including an inlet for introducing hot solids directly from the internal circulation of the furnace to the second heat exchange chamber. The heat exchanger also preferably includes a third discharge for removing a second portion of the cooled solids from the first heat exchange chamber directly to the furnace.

9 Claims, 3 Drawing Sheets

(56) References Cited

U.S. PATENT DOCUMENTS

| | | | | |
|---|---|---|---|---|
| 5,239,946 | A | 8/1993 | Garcia-Mallol | 122/4 D |
| 5,275,788 | A | 1/1994 | Stoholm | 422/145 |
| 5,474,034 | A * | 12/1995 | Gounder | 122/4 D |
| 5,526,775 | A | 6/1996 | Hyppanen | |
| 5,537,941 | A * | 7/1996 | Goidich | 110/348 |
| 7,240,639 | B2 * | 7/2007 | Hyppanen et al. | 122/4 D |
| 7,543,553 | B2 * | 6/2009 | Watanabe | 122/4 D |
| 2007/0022924 | A1 | 2/2007 | Hyppanen et al. | 110/245 |
| 2007/0283906 | A1 * | 12/2007 | Albrecht | 122/406.1 |

FOREIGN PATENT DOCUMENTS

| | | | |
|---|---|---|---|
| JP | 7-301401 | A | 11/1995 |
| JP | 9-512093 | A | 12/1997 |
| RU | 2 107 866 | C1 | 3/1998 |
| SU | 1781509 | A1 | 12/1992 |
| WO | WO 95/10733 | | 4/1995 |
| WO | WO 95/10733 | A1 | 4/1995 |
| WO | WO 2004/091768 | A1 | 10/2004 |

OTHER PUBLICATIONS

Written Opinion of the International Searching Authority mailed May 23, 2008, issued in International Application No. PCT/FI2007/050264.

Russian Decision on Grant dated Feb. 15, 2010, issued in corresponding Russian patent application No. 2008148570/05(063614), with English translation.

Chinese Office Action dated Jan. 29, 2009, issued in corresponding Chinese patent application No. 200780016720.5, and English translation.

English translation of Japanese Official Action dated Aug. 30, 2011, issued in counterpart Japanese patent application No. 2009-508412.

* cited by examiner

FLUIDIZED BED HEAT EXCHANGER FOR A CIRCULATING FLUIDIZED BED BOILER AND A CIRCULATING FLUIDIZED BED BOILER WITH A FLUIDIZED BED HEAT EXCHANGER

This application is a U.S. national stage application of PCT International Application No. PCT/FI2007/050264, filed May 9, 2007, published as PCT Publication No. WO 2007/128883 A2, and which claims priority from Finnish patent application number 20065308, filed May 10, 2006.

FIELD OF THE INVENTION

The present invention relates to a fluidized bed heat exchanger for a circulating fluidized bed boiler (CFB boiler), and to a circulating fluidized bed boiler with such a heat exchanger. More specifically, the invention relates to the external hot circulation of the CFB boiler, in other words, to an efficient heat exchanger arranged in the return channel for solids, which have been separated from the exhaust gas of the CFB boiler by a particle separator, and which are to be returned to the furnace. The invention especially relates to arranging an efficient heat exchanger in a supercritical once-through utility boiler (OTU boiler), which is provided with reheating.

BACKGROUND OF THE INVENTION

In CFB boilers, generation of hot steam from feed water takes place in several stages, for example, by means of heat exchangers arranged in the backpass of the boiler, by means of water tube panels of the furnace and backpass walls, and in heat exchange chambers arranged in the external hot circulation. As larger and more efficient CFB boilers are developed, heat exchange chambers in the external hot circulation become increasingly important. Therefore, ways must be found to advantageously provide the boilers with heat exchange chambers that are capable of producing a sufficiently high heat transfer power, while still operating flexibly in various operating conditions.

OTU boilers have the advantage of not needing a density different between water and steam, to provide the driving force for water circulation which cools the evaporator tubes of the furnace walls of the boiler. Instead of the density difference, the feed water pump of the boiler acts as the driving force for the water circulation. Therefore, in OTU boilers, it is possible to heat the steam to high temperatures at pressures above the critical point of water (220 bar), which improves the efficiency of the water vapor generation process of the boiler. In suspension-fired boilers, in operation and having capacities of about 1000 $MW_e$, in which the temperature of the flue gas exiting the furnace may be about 1300° C., the achieved end temperature of steam at about 300 bar pressure has been 610° C. In CFB boilers, in which the furnace temperature is typically 850° to 900° C., achieving corresponding steam values and, especially, a high reheat temperature, e.g., 620° C., calls for new solutions in the designing of boiler heat exchangers.

A heat exchanger has a high efficiency when a large amount of solids, having a high inlet temperature and low outlet temperature, flows through it. In general, it is possible to raise the efficiency of the heat exchanger by increasing its heat exchange surface, which requires that the volume of the fluidized bed in the heat exchange chamber is large enough. Increasing the height of the fluidized bed increases the pressure loss of the fluidizing gas, and increasing its width and depth may lead to disadvantageous solutions in view of the structure or space consumption. To avoid these problems, it is advantageous to use at least two separate heat exchange chambers, instead of one large heat exchange chamber.

U.S. Pat. No. 5,275,788 discloses a heat exchanger of a CFB boiler comprising two heat exchange chambers arranged in association with the furnace wall, one on top of the other, but in parallel, in view of the particles flow. Desirable portions of the solids separated from the boiler exhaust gas by means of a particle separator may be introduced into these heat exchange chambers. With this kind of a heat exchanger, the solids to be introduced into both heat exchange chambers have the same temperature, and the end temperature of the solids remains very high. Thus, the heat exchange efficiency of the heat exchanger, and the adjustability of the heat exchange efficiency, may be inadequate, especially at low loads.

U.S. Pat. No. 5,537,941 discloses a heat exchanger with two stacked sections, an upper and a lower section, connected with each other in series, both sections having two heat exchange chambers connected in parallel. Both the upper section and the lower section also comprise a bypass channel through which a portion of the solids entering each section may be passed in a non-cooled condition, past the heat exchange chambers into the solids exiting the section. The adjustability of this kind of a heat exchanger is quite good, but even here, the efficiency and flexibility of the heat exchanger are not necessarily sufficient in all operational conditions of the boiler.

SUMMARY OF THE INVENTION

An object of the present invention is to provide a heat exchanger, to be arranged in the external hot circulation path of a circulating fluidized bed boiler, for reducing the above-mentioned drawbacks of prior art heat exchangers of the circulating fluidized bed boiler.

Another object of the invention is to provide a heat exchanger to be arranged in the external hot circulation of the circulating fluidized bed boiler, which heat exchanger is applicable to high efficiency once-through utility circulating fluidized bed boilers provided with reheating.

A further object of the invention is to provide a circulating fluidized bed boiler with a heat exchanger as described above.

To solve the problems involved in the prior art, the present invention provides particular aspects of a heat exchanger and a circulating fluidized bed boiler as set forth in the claims.

Hence, in accordance with one aspect of the present invention, a heat exchanger comprises a first heat exchange chamber and a second heat exchange chamber arranged in association with a furnace of a circulating fluidized bed boiler, a first inlet channel for introducing hot solids from the particle separator of the external circulation of the circulating fluidized bed boiler into the first heat exchange chamber, which is provided with a first means for fluidizing solids, a second inlet channel for introducing solids into the second heat exchange chamber, which is provided with a second means for fluidizing solids, a first discharge for removing a first portion of the cooled solids from the first heat exchange chamber into the second inlet channel, a second discharge for removing the cooled solids from the second heat exchange chamber into the furnace, and an inlet for introducing hot solids from the internal circulation of the furnace directly into the second heat exchange chamber.

Thus, the present invention offers a new solution for providing an efficient heat exchanger, wherein the heat exchanger comprises two heat exchange chambers, connected in series in the external hot circulation of a CFB boiler, and a means for introducing hot solids from the internal circulation of the furnace directly into the latter heat exchange chamber. In this kind of a heat exchanger, it is possible to obtain a sufficiently high flow of solids, a sufficiently high inlet temperature of the solids and, at the same time, a relatively low outlet temperature of the solids in both heat exchange chambers.

In accordance with a preferred embodiment of the present invention, the heat exchanger also comprises a third discharge for removing a second portion of the cooled solids from the first heat exchange chamber directly into the furnace. Preferably, the third discharge and the first discharge, referred to above, comprise a controller for controlling the amounts of the first and second portions of the cooled solids. Thus, it is possible, for example, to prevent the solids cooled in the first exchange chamber from flowing into the second heat exchange chamber, if necessary, in which case, solids flow to the second heat exchange chamber directly from the furnace only. Thus, the inlet temperature of the solids in the second heat exchange chamber is the highest possible, and in the second heat exchange chamber, for example, reheating of the steam returning from the high-pressure turbine to a sufficiently high temperature can be accomplished.

A heat exchanger arrangement similar to the one described in the above embodiment is also applicable to a circulating fluidized bed boiler driven by different combustion modes, in which one combustion mode requires efficient cooling of solids in two heat exchanger chambers connected in series, and another combustion mode requires cooling of the solids in one heat exchange chamber only. In the latter case, it is possible to return the solids to the furnace directly from the first heat exchange chamber, the second heat exchange chamber being not used at all. Of these two combustion modes, the first may correspond, for example, to combustion in which the oxidizing gas is air-enriched with oxygen, or even pure oxygen, whereas, the latter corresponds to combustion with ordinary air.

The two heat exchange chambers of the exchanger, in accordance with the present invention, which are connected in series, may be arranged adjacently in connection with the furnace wall of the CFB boiler, but, in accordance with an especially advantageous embodiment of the invention, the first heat exchange chamber of the heat exchanger is arranged above the second heat exchange chamber. This embodiment is especially advantageous in large CFB boilers, which comprise several efficient and relatively small particle separators, in which case, two superposed and separate heat exchange chambers may be arranged in the space remaining below them. In two superposed heat exchange chambers, the pressure loss of the fluidizing gas in the fluidized bed of the solids remains lower than that in a corresponding undivided high chamber.

When the heat exchanger in accordance with the invention is connected to a supercritical OTU boiler, the end temperature required for superheating may be considerably high, for example, 610° C., and the end temperature required for reheating may be even higher, for example, 620° C. In this case, when the temperature in the CFB boiler furnace is, for example, 850° to 900° C., the heat exchanger containing the last heat exchange surface of the boiler steam cycle must be arranged in a very effective manner, in order to gain the desired superheating temperatures. It is possible to advantageously implement this kind of a heat exchanger, in accordance with the present invention, so that the last superheater of the steam cycle is arranged in the first heat exchange chamber of the heat exchanger, and the last reheater of the boiler steam cycle is arranged in the second heat exchange chamber, which is most preferably arranged below the first heat exchange chamber. When, according to the invention, hot solids are fed from the furnace directly to one of the heat exchange chambers connected in series, it is possible to achieve a sufficient reheating temperature in this heat exchange chamber, at all loads of the boiler. This results, above all, from the inventor's surprising discovery that, in large once-through utility circulating fluidized bed boilers, the temperature in the lower section of the boiler is usually higher than the temperature in the upper section of the boiler, because of the considerable height of the boiler, and the heat exchange surfaces being arranged in the furnace. Therefore, solids fed directly from the internal circulation of the furnace, the temperature of which is close to the temperature of the lower section of the boiler, are hotter than the solids separated from the exhaust gases of the furnace, the temperature of which corresponds to the temperature in the upper section of the boiler. It has especially been found that the temperature difference between the upper and lower sections of the CFB boiler furnace becomes more prominent at low loads, when reaching a sufficient reheat temperature with normal modes is especially difficult. Achieving a sufficient superheating temperature, on the other hand, is no problem, because, at all loads, the efficiency of the boiler is raised so high that the desired superheating temperature will be reached.

BRIEF DESCRIPTION OF THE DRAWINGS

The invention is described in more detail below, with reference to the attached drawings, in which.

DETAILED DESCRIPTION OF THE PREFERRED EMBODIMENTS

Figure 1:
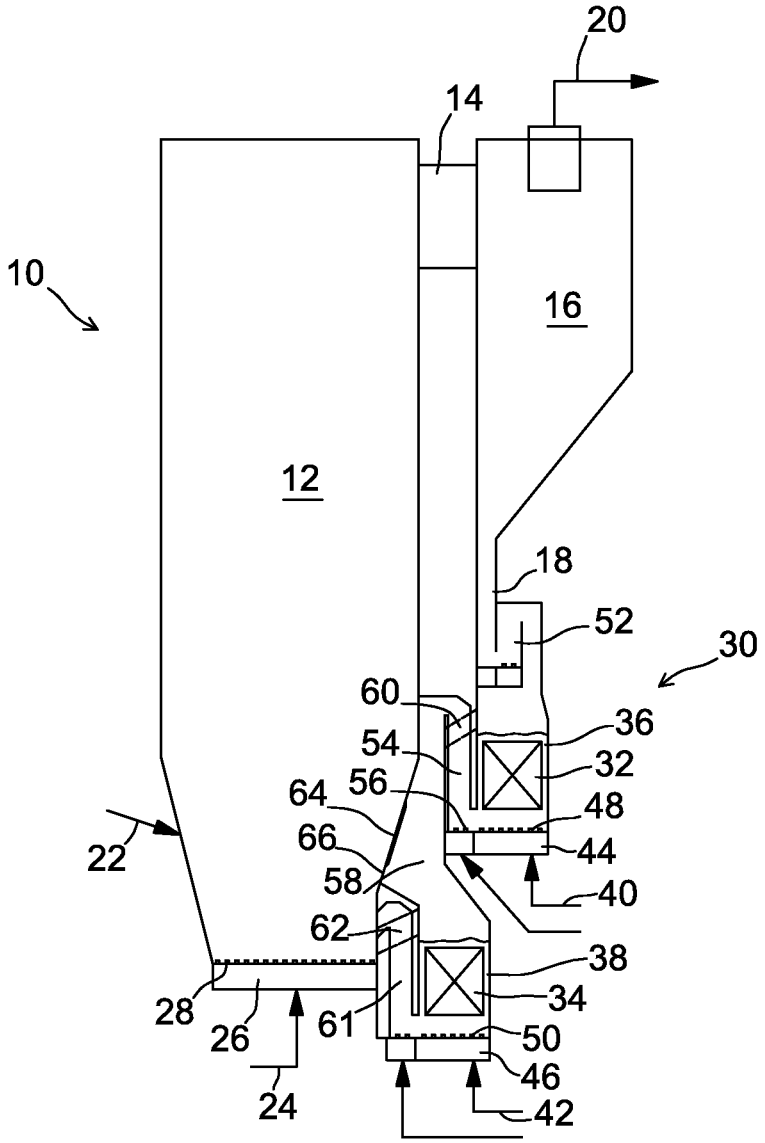
FIG. 1 is a schematic vertical cross section of a circulating fluidized bed boiler provided with a heat exchanger in accordance with a first preferred embodiment of the present invention.

FIG. 1 illustrates a CFB boiler 10 in accordance with a preferred embodiment of the present invention, which boiler comprises a furnace 12, an outlet channel 14 connected with the upper section of the furnace 12, a particle separator 16 for external hot circulation, connected with the outlet channel 14, the lower portion of the particle separator 16 being joined with a return channel 18, which returns the solids separated with particle separator 16 to the lower section of the furnace 12, and the upper portion of the particle separator 16 being joined with a flue gas duct 20 for removing cleaned flue gas to the backpass of the boiler 10, the gas cleaning device and further, through the stack to the environment. (As the last mentioned devices are known from the prior art, and as they are not specifically part of the present invention, they are not shown in FIG. 1.) The CFB boiler 10, for example, may be of a natural circulation type or a supercritical once through utility (OTU) boiler. The lower section of the furnace 12 is provided with means 22 for feeding fuel, inert bed material and possibly sulfur binder to the furnace 12, and the bottom of the furnace 12 is provided with a gas inlet channel 24, wind box 26 and nozzles 28 for feeding oxide-containing fluidizing gas.

In operation of the boiler 10, oxide-containing fluidizing gas, for example, air, fed through nozzles 28 at an adequate velocity, makes the fuel burn in a fluidized bed, typically, at a temperature of about 850° to 900° C., in which case, flue gas and entrained solids, primarily ashes, inert bed material and unburned fuel, exit the upper section of the boiler 10 through the outlet channel 14 and enter the particle separator 16. The particle separator 16 separates hot solids from the flue gas, which hot solids are passed through the return channel 18 to the heat exchanger 30, where heat exchange surfaces 32, 34 arranged in the heat exchanger 30 cool the solids before they are returned to the lower section of the furnace 12. A large CFB boiler 10 is usually provided with several parallel particle separators 16 and heat exchangers 30 connected to their return channel 18, but, for clarity reasons, FIG. 1 illustrates an arrangement related to one particle separator, only.

Normally, the walls of the furnace 12 are made of water tube panels serving as so-called evaporating surfaces, in which the high-pressure feed water of the boiler steam cycle, heated in an economizer (not shown in FIG. 1) arranged in the boiler backpass, is converted to steam. The steam temperature is further raised in superheaters, the last stage of the superheaters being normally arranged in the heat exchanger 30 of the external hot circulation path. The superheated steam is passed into a high pressure steam turbine (not shown), having a generator connected therewith, for generating electricity. In high-efficiency boilers 10, the steam leaving the high-pressure turbine at a lower pressure is passed to reheaters for reheating. Advantageously, the last stage of the reheaters also may be arranged in the heat exchanger 30 of the external hot circulation path. The hot steam generated thereby is further passed to a lower-pressure steam turbine (not shown), in order to increase the quantity of produced electricity and the total efficiency of the plant. Steam generation exploiting reheat is known, per se, and it is, therefore, unnecessary to describe it here in further detail.

In a preferred embodiment of the present invention, illustrated in FIG. 1, the heat exchanger 30 comprises a first heat exchange chamber 36 and a second heat exchange chamber 38 arranged below the first heat exchange chamber 36, each heat exchange chamber 36, 38 being provided with a heat exchange surface 32, 34, respectively. The bottoms of the first and second heat exchange chambers 36, 38 are provided with a gas inlet duct 40, 42, wind box 44, 46 and nozzles 48, 50 for fluidizing the bed of solids being formed in the heat exchange chambers 36, 38.

In accordance with a preferred embodiment shown in FIG. 1, the hot solids flowing from the particle separator 16 are passed along the return channel 18 through a gas seal 52 into the upper part of the fluidized bed of particles in the first heat exchange chamber 36. The lower section of the first heat exchange chamber 36 is preferably connected with a lifting channel 54, the lower section of the lifting channel being provided with nozzles 56, which make the solids flow at a desired velocity through the heat exchange chamber 36 and to be further discharged through the upper part of the lifting channel 54 into an inlet channel 58 of the second heat exchange chamber 38. The upper section of the first heat exchange chamber 36 is preferably arranged with an overflow channel 60 through which excess solids are discharged, if the amount of solids to be discharged through the lifting channel 54 is less than the amount of solids entering the first heat exchange chamber 36 through the particle separator 16. The amount of solids passing through the heat exchange member 36 is, preferably, adjustable by means of the lifting channel 54 and overflow channel 60. In some cases, other known arrangements for the heat exchange chamber 36 may be used, for example, such as is disclosed in U.S. Pat. No. 5,537,941.

In the arrangement of FIG. 1, the lower heat exchange chamber 38 is equal to the upper heat exchange chamber 36, except that in the lower heat exchange chamber 38, the flow of particles entering the heat exchange chamber 38 is passed from the upper part of the lifting channel 54 of the upper heat exchange chamber 36 and from the overflow channel 60 along the inlet 58 into the upper part of the fluidized bed of particles in the lower heat exchange chamber 38. Furthermore, the solids to be discharged from the upper part of the lifting channel 61 of the lower heat exchange chamber 38 and from the overflow channel 62, are passed into the furnace 12.

In accordance with a preferred embodiment of the present invention, shown in FIG. 1, the upper section of the lower heat exchange chamber 38, preferably, the inlet channel 58, comprises inlet openings 64 for passing solids into the heat exchange chamber 38 directly from the internal circulation of the solids in the furnace 12. The inlet openings are preferably arranged on the oblique surfaces 66 in the lower section of the furnace, in which case, hot solids flow through openings 64 into the heat exchange chamber 38, also, at small loads of the boiler 10, in which case, the fluidizing velocity of the solids in the furnace 12 is relatively low.

In accordance with a preferred embodiment of the invention, the heat exchange surface 32 of the upper heat exchange chamber 36 is the last superheater of the steam cycle boiler 10 and the heat exchange surface 34 of the lower heat exchange chamber 38 is the last reheater of the steam cycle. As the temperature of the furnace 12 in a large once-through utility circulating fluidized bed boiler 10 is at its highest in the lower section of the boiler 10, especially, at low loads, this arrangement is capable of providing a sufficiently high reheat temperature. The heat exchange surfaces 32, 34 of the heat exchange chambers 36, 38 also may be other heat exchange surfaces, for example, both of them can be either superheaters or reheaters.

Figure 2:
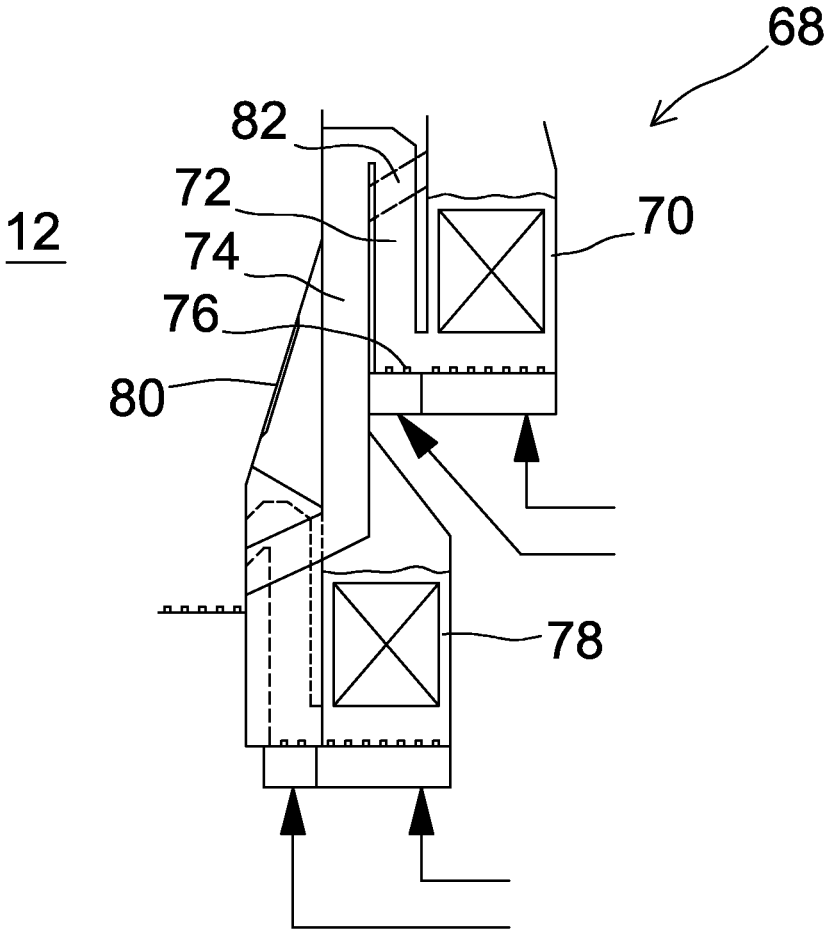
FIG. 2 is a schematic vertical cross section of a heat exchanger in accordance with a second preferred embodiment of the present invention.

FIG. 2 illustrates a heat exchanger 68 in accordance with a second preferred embodiment of the invention. The heat exchanger 68 differs from the heat exchanger 30 shown in FIG. 1 only in that the upper heat exchange chamber 70 of it is provided with a second lifting channel 72 by the side of the lifting channel 54 leading to the lower heat exchange chamber 78, which second lifting channel 72 passes solids being discharged from the upper heat exchange chamber 70 along the discharge channel 74 directly to the furnace 12. The lower part of the lifting channel 72 is provided with separate fluidizing gas nozzles 76, so that by passing fluidizing gas either to the first nozzles 56 in accordance with FIG. 1 or to the second nozzles 76 in accordance with FIG. 2, it is possible to introduce solids cooled in the upper heat exchange chamber 70 either to the lower heat exchange chamber 78 or directly to the furnace 12.

The material cooled in the upper heat exchange chamber 70 is preferably passed to the lower heat exchange chamber 78, when it is desirable to recover as much energy as possible from the solids separated, by a particle separator. The material cooled in the upper heat exchange chamber 70 is preferably passed directly to the furnace 12 when it is desirable that the temperature of the solids entering the lower heat exchange chamber 78 be as high as possible. Therefore, only non-cooled solids enter the lower heat exchange chamber 78, either directly from the internal circulation of the furnace 12, exclusively, through inlet openings 80, or possibly, also from the external hot circulation through the overflow channel 82.

Figure 3:
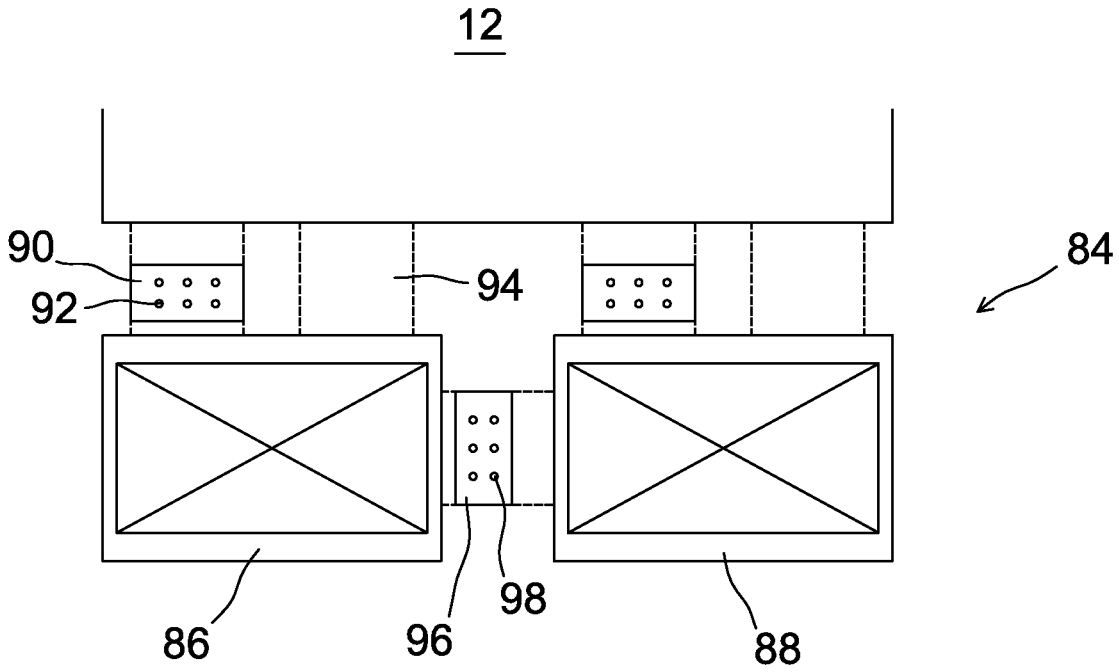
FIG. 3 is a schematic horizontal cross section of a heat exchanger in accordance with a third preferred embodiment of the present invention.

FIG. 3 is a schematic illustration of a horizontal cross section of a heat exchanger 84 in accordance with a third preferred embodiment of the invention.

This embodiment deviates from the other described embodiments specifically, in that it comprises a first heat exchange chamber 86 and a second heat exchange chamber 88, which are connected in series in view of the solids flow and arranged in parallel in association with the wall of the furnace 12. The solids discharged from the particle separator of the external hot circulation of the circulation fluidized bed boiler 10 are passed along the return channel to the first heat exchange chamber 86, from the lower section, whereby it is possible to return the solids to the furnace 12 through a lifting channel 90. If there is not enough fluidizing gas introduced into the lifting channel 90 through fluidizing gas nozzles 92 arranged in the lower part of the channel, the solids entering the first heat exchange chamber 86, or a portion of it, may end up in the furnace 12 through an overflow channel 94 attached to the upper section of the chamber 86.

A specific feature of the first heat exchange chamber 86, illustrated in FIG. 3, is a second lifting channel 96, attached to the lower section thereof, by means of which lifting channel 96, it is possible to pass solids from the lower section of the first heat exchange chamber 86 to the upper section of the second heat exchange chamber 88. The lower part of the lifting channel 96 is provided with separate fluidizing gas nozzles 98, so by feeding fluidizing gas in a suitable proportion through the nozzles 92, 98 of the lifting channels 90, 96, it is possible to pass a desirable portion of the material cooled in the first heat exchange chamber 86 to the second heat exchange chamber 88. Preferably, the first and the second heat exchange chambers 86, 88 comprise inlet means corresponding to those illustrated, e.g., in FIG. 1, through which inlet means, it is also possible to feed hot solids directly from the internal circulation of the furnace 12.

FIG. 3 illustrates two heat exchange chambers 86, 88 connected in series. In accordance with another preferred embodiment, the heat exchange chamber comprises three heat exchange chambers arranged in parallel, the utmost two of the heat exchange chambers 86, 88 serving as first heat exchange chambers, with hot solids directly from the particle separator being introduced into both of them. A third chamber is preferably arranged between the first two chambers 86, 88, so that it is possible to feed cooled solids, if desired, from either of the first chambers or from both of them, to this mid-most chamber.

FIG. 3 shows, for clarity reasons, that there is only one lifting channel of each type 90, 96, but for structural and operational reasons, it is often better to divide the lifting channel into two or more parallel channels. Thus, for example, an overflow channel 94 may preferably be arranged between two parallel lifting channels. Naturally, the number of chambers connected in different manners may also be higher than what has been described above. It is also possible that part of the chambers are connected in parallel, as shown in FIG. 3, and another part in a superposed manner, as shown in FIGS. 1 and 2.

The invention has been described above with reference to a few exemplary arrangements. These arrangements are not intended to limit the scope of the invention, but the invention is limited only by the accompanying claims and the definitions therein.

The invention claimed is:

1. A heat exchanger of a supercritical once-through circulating fluidized bed boiler having a furnace and a boiler steam cycle, said heat exchanger comprising:

a first heat exchange chamber and a second heat exchange chamber arranged in connection with the furnace of the supercritical once-through circulating fluidized bed boiler, the first heat exchange chamber comprising a final superheater of the boiler steam cycle of the supercritical once-through circulating fluidized bed boiler and the second heat exchange chamber comprising a final reheater of the boiler steam cycle of the supercritical once-through circulating fluidized bed boiler;

a first inlet channel for introducing hot solids from a particle separator of an external circulation of the supercritical once-through circulating fluidized bed boiler into the first heat exchange chamber, which is provided with first means for fluidizing solids;

a second inlet channel for introducing solids into the second heat exchange chamber, which is provided with second means for fluidizing solids;

a first discharge for removing a first portion of cooled solids from the first heat exchange chamber to the second inlet channel;

a second discharge for removing cooled solids from the second heat exchange chamber to the furnace of the supercritical once-through circulating fluidized bed boiler; and an inlet for introducing hot solids from an internal circulation of the furnace of the supercritical once-through circulating fluidized bed boiler directly to the second heat exchange chamber.

2. A heat exchanger in accordance with claim 1, further comprising a third discharge for removing a second portion of the cooled solids from the first heat exchange chamber directly to the furnace of the supercritical once-through circulating fluidized bed boiler.

3. A heat exchanger in accordance with claim 2, wherein the first discharge and the third discharge comprise controllers for controlling the amounts of the first and second portions of the cooled solids that are removed from the first heat exchange chamber.

4. A heat exchanger in accordance with claim 1, wherein the first heat exchange chamber is arranged above the second heat exchange chamber.

5. A supercritical once-through circulating fluidized bed boiler having a boiler steam cycle, the supercritical once-through circulating fluidized bed boiler comprising:

(a) a furnace for combusting solids in a circulating fluidized bed;

(b) a particle separator for separating in an external hot circulation of the supercritical once-through circulating fluidized bed boiler; and (c) a heat exchanger arranged in a return channel of the external hot circulation, the return channel returning solids separated in the particle separator to the furnace, wherein the heat exchanger comprises:

(i) a first heat exchange chamber and a second heat exchange chamber arranged in connection with a furnace, the first heat exchange chamber comprising a final superheater of the boiler steam cycle of the supercritical once-through circulating fluidized bed boiler and the second heat exchange chamber comprising a final reheater of the boiler steam cycle of the supercritical once-through circulating fluidized bed boiler;

(ii) a first inlet channel for introducing hot solids from the particle separator of the external circulation of the supercritical once-through circulating fluidized bed boiler into the first heat exchange chamber, which is provided with first means for fluidizing solids;

(iii) a second inlet channel for introducing solids into the second heat exchange chamber, which is provided with second means for fluidizing solids;

(iv) a first discharge for removing a portion of the cooled solids from the first heat exchange chamber to a second inlet channel;

(v) a second discharge for removing cooled solids from the second heat exchange chamber to the furnace; and (vi) an inlet for introducing hot solids from the internal circulation of the furnace directly to the second heat exchange chamber.

6. A supercritical once-through circulating fluidized bed boiler having (i) a furnace for combusting fuel and combustion supporting gas, and for producing hot solids and exhaust gas, and (ii) a boiler steam cycle, said supercritical once-through circulating fluidized bed boiler comprising:

a first heat exchange chamber arranged in connection with the furnace of the supercritical once-through circulating fluidized bed boiler, the first heat exchange chamber comprising a final superheater of the boiler steam cycle of the supercritical once-through circulating fluidized bed boiler;

second beat exchange chamber arranged in connection with the furnace of the supercritical once-through circulating fluidized bed boiler, the second heat exchange chamber comprising a final reheater of the boiler steam cycle of the supercritical once-through circulating fluidized bed boiler;

an external circulation of the supercritical once-through circulating fluidized bed boiler, the external circulation including a particle separator for separating the hot solids and the exhaust gas from the furnace of the circulating fluidized bed boiler;

a first inlet channel for receiving the hot solids from the particle separator of the external circulation and for introducing the hot solids into the first heat exchange chamber, which is provided with a first fluidizer for fluidizing solids;

a second inlet channel for introducing solids into the second heat exchange chamber, which is provided with second fluidizer for fluidizing solids;

a first discharge for removing a portion of cooled solids from the first heat exchange chamber and for feeding the portion to the second inlet channel to be introduced into the second heat exchange chamber;

a second discharge for removing cooled solids from the second heat exchange chamber and to feeding the cooled solids from the second heat exchange chamber into the furnace of the supercritical once-through circulating fluidized bed boiler; and an inlet for introducing hot solids from an internal circulation of the furnace directly to the second heat exchange chamber, in order to assure a high heat exchange rate in the second heat exchange chamber, even at low loads.

7. A circulating fluidized bed boiler in accordance with claim 6, further comprising a third discharge for removing a second portion of the cooled solids from the first heat exchange chamber directly to the furnace of the supercritical once-through circulating fluidized bed boiler.

8. A circulating fluidized bed boiler with claim 7, wherein the first discharge and the third discharge comprise controllers for controlling the amounts of the first and second portions of the cooled solids that are removed from the first heat exchanger.

9. A circulating fluidized bed boiler in accordance with claim 6, wherein the first heat exchange chamber is arranged above the second heat exchange chamber.

* * * * *